US009033688B2

(12) United States Patent
Kowalchuk

(10) Patent No.: US 9,033,688 B2
(45) Date of Patent: May 19, 2015

(54) HYDRAULICALLY POWERED BALL VALVE LIFT APPARATUS AND METHOD FOR DOWNHOLE PUMP TRAVELLING VALVES

(71) Applicant: Tru Lift Supply Inc., Calgary (CA)

(72) Inventor: Alexander Kowalchuk, Estevan (CA)

(73) Assignee: Tru Lift Supply Inc., Calgary, Alberta (CA)

( * ) Notice: Subject to any disclaimer, the term of this patent is extended or adjusted under 35 U.S.C. 154(b) by 0 days.

(21) Appl. No.: 14/259,386

(22) Filed: Apr. 23, 2014

(65) Prior Publication Data

US 2015/0098840 A1 Apr. 9, 2015

(51) Int. Cl.
*F04B 47/00* (2006.01)
*F04B 53/10* (2006.01)

(52) U.S. Cl.
CPC ..... *F04B 53/1002* (2013.01); *F04B 47/00* (2013.01)

(58) Field of Classification Search
CPC ..... F04B 47/00; F04B 53/1002
USPC ..... 417/507, 508, 554; 137/533.11–533.15, 137/494
See application file for complete search history.

(56) References Cited

U.S. PATENT DOCUMENTS

| | | | | |
|---|---|---|---|---|
| 2,344,786 | A | 3/1944 | Patterson | |
| 4,599,054 | A | 7/1986 | Spears | |
| 4,691,735 | A * | 9/1987 | Horton | 137/494 |
| 4,708,597 | A | 11/1987 | Fekete | |
| 4,741,679 | A | 5/1988 | Blassingame | |
| 4,781,543 | A | 11/1988 | Sommer | |
| 4,781,547 | A | 11/1988 | Madden | |
| 4,867,242 | A | 9/1989 | Hart | |
| RE33,163 | E | 2/1990 | Madden | |
| 4,907,953 | A | 3/1990 | Hebert et al. | |
| 5,139,398 | A | 8/1992 | Downing | |
| 5,141,411 | A | 8/1992 | Klaeger | |
| 5,407,333 | A | 4/1995 | Lambright | |
| 5,628,624 | A | 5/1997 | Nelson | |
| 5,642,990 | A | 7/1997 | Short | |
| 5,829,952 | A | 11/1998 | Shadden | |
| 5,992,452 | A | 11/1999 | Nelson | |
| 6,481,987 | B2 | 11/2002 | Ford | |
| 7,051,813 | B2 | 5/2006 | Hayes | |
| 7,878,767 | B2 | 2/2011 | Ford | |
| 2005/0053503 | A1 | 3/2005 | Gallant | |
| 2013/0025846 | A1 | 1/2013 | Scott | |

FOREIGN PATENT DOCUMENTS

| | | |
|---|---|---|
| WO | 2011147031 | 12/2011 |

* cited by examiner

*Primary Examiner* — Charles Freay
*Assistant Examiner* — Philip Stimpert
(74) *Attorney, Agent, or Firm* — Kyle R. Satterthwaite; Ryan W. Dupuis; Ade & Company Inc.

(57) ABSTRACT

The Invention provided is a hydraulic powered down hole reciprocating pump traveling valve component to provided lifting hydraulics on the down stroke using the derived motion and pressure of petroleum liquids and gasses, such as oil, water and natural gas and also utilizing the frictional traveling forces driven by the surface equipment. Designed to utilize the elements within the pumping apparatus to obtain the hydraulic power within and transfer the energy's force to the exposed bottom end of the pressure locked traveling ball valve adjacent within the ball valve containment cage, providing ultimate lifting power to open the ball valve on the initiation of the down stroke. The component consist of a Hollow Hydraulic Power Shaft, Hollow Pressure Motion House, and a Fluid Cavity Power Drag Plunger.

14 Claims, 2 Drawing Sheets

HYDRAULICALLY POWERED BALL VALVE LIFT APPARATUS AND METHOD FOR DOWNHOLE PUMP TRAVELLING VALVES

FIELD OF THE INVENTION

The present invention relates generally to devices using a sliding shaft carrying a drag plunger to displace a ball valve of a downhole pump's travelling valve during a downstroke of the travelling valve, and more particularly to such a device that employs a hollow shaft to allow at least some the produced fluid to pass through the open travelling valve via a hollow interior of the shaft.

BACKGROUND OF THE INVENTION

It is well known in the art to use a downhole pump as a means for artificial lift of oil form a petroleum reservoir, for example to either increase production rates in a naturally producing reservoir or to continue production from a formation at which there is insufficient pressure to naturally produce the fluids to the surface. A downhole pump typically features a pump barrel in which a plunger or piston is slidably disposed. The plunger or piston is attached to the south end of a string of sucker rods that depends into the wellbore to couple the plunger or piston to a suitable pumping unit at the surface that drives reciprocation of the string in order to reciprocate the piston or plunger within the pump barrel.

A standing valve resides at a stationary position at a south end of the pump barrel, while a travelling valve is carried at the south end of the pump piston or plunger for reciprocal movement therewith within the pump barrel under operation of the at-surface pumping unit.

During the upstroke drawing the sucker rod string northward (i.e. in the direction of the wellbore leading toward the pumping unit at the surface), the volume between the rising piston/plunger and the standing valve increases, thereby reducing the pressure inside the pump barrel. With a pressure differential introduced across the standing valve, the higher pressure of the reservoir fluid forces this valve open, thereby introducing the fluid into the interior of the pump barrel. During the upstroke, the hydrostatic pressure of fluid present in the production tubing above the pump barrel keeps the travelling valve closed.

During the subsequent downstroke, the effective internal volume of the pump barrel is decreased by the southward displacement of the piston/plunger, thereby increasing the fluid pressure inside the pump barrel. The pressure differential between the interior and exterior of the pump barrel thus reverses, with the higher pressure fluid inside the pump barrel forcing the standing valve closed, thereby trapping this fluid inside the pump barrel. The rising pressure in the pump barrel increases to a level exceeding the pressure applied to the north side of the travelling valve by the fluid column above the pump barrel, thereby forcing the ball valve of the travelling valve assembly open from the south side thereof and allowing the fluid from this south side of the travelling valve to pass northward therethrough.

It is known in the prior art to add a ball valve lifter to the travelling valve assembly to aid in lifting of the ball valve of the travelling valve assembly from its seat during the downstroke of the downhole pump. Examples of such devices are found in U.S. Pat. No. 7,878,767 and U.S. Patent Application Publication No. 2013/0025846. In these references, a housing is attached to the south end of the travelling valve assembly, and a shaft or piston is slidably disposed in the housing and carries a drag plunger at a south end of the shaft or piston outside the housing. During the downstroke of the downhole pump, the housing moves southward (i.e. further into the wellbore from the surface, or further 'downhole') with the travelling valve, but frictional engagement of the drag plunger with the surrounding inner wall surface of the pump barrel resists or prevents movement in the same direction, and/or abutment of the drag plunger against fluid in the pump barrel hydraulically resists or blocks such movement, whereby the device housing moves closer to the drag plunger, thereby relatively displacing the north end of the piston or shaft northward in the housing, until it projects from the housing's north end and knocks the ball valve of the travelling valve from its seated position.

In each of these two prior art devices, the ball lift device is configured to allow the fluid to move northwardly only externally of a shaft or plunger of solid cross-section.

For further reference, additional prior art concerning downhole pumps and associated valve lifters/releasers/assistants includes U.S. Pat. Nos. RE33163, 7,878,767, 4,907,953, 5,628,624, 5,992,452, 5,829,952, 4,867,242, 5,407,333, 7,051,813, 4,708,597, 5,139,398, 5,141,411, 2,344,786, 4,691,735, 5,642,990 4,741,679, 6,481,987, 4,599,054, 4,781,543, 4,781,547 and 5,829,952 and U.S. Patent Application Publications 2013/0025846 and 2005/0053503.

Applicant has developed a unique design of ball lifter that notably departs from the teachings of such prior art solutions in this field.

SUMMARY OF THE INVENTION

According to one aspect of the invention there is provided a ball valve lift apparatus for use with a reciprocating downhole pump having a travelling valve assembly on a piston that is slidingly disposed in a pump barrel and features a ball valve that seals against a ball seat when in a closed position, the ball valve lift apparatus comprising:

a hollow housing having a north end arranged for coupling to the piston of the downhole pump to reside in a position south of the ball seat of the valve assembly, the hollow housing having a hollow interior that is open to an exterior of the hollow housing at both the north end of the housing and an opposing south end thereof;

a shaft partially disposed within the axial bore of the hollow housing in a manner slidable back and forth therein, the shaft having a hollow interior flow passage passing axially therethrough between opposing north and south ends of the shaft; and a drag plunger attached to a south end of the shaft disposed outside of the hollow housing beyond the south end of said housing for frictional contact of said drag plunger with an internal surface of the pump barrel, the hollow interior flow passage of the shaft being in fluid communication with a space external of the drag plunger beyond a south end thereof;

the shaft being slidable relative to the housing between a first position in which the drag plunger is spaced southward of the south end of the housing and the north end of the piston is disposed within the housing, and a second position in which the drag plunger is nearer to the south end of the housing than in the first position and the shaft projects externally northward of the housing from the north end thereof by a sufficient distance to displace the ball valve from the ball seat, thereby enabling fluid flow northward through the ball seat via the hollow interior flow passage of the shaft.

Preferably there is at least one external flow passage open between the shaft and internal surfaces of the housing to enable south to north passage of additional fluid through the housing externally of the shaft.

Preferably the shaft comprises guides at an exterior thereof for following the internal surfaces of the housing to guide relative sliding between the shaft and the housing, and the at least one external flow passage comprises a plurality of external flow passages defined between said guides.

Preferably the guides each comprise a plurality of grooves defined at a radially outermost extent of the guide, the grooves of each guide being spaced apart in a north-south direction and running between adjacent external flow passages on opposite sides of said guide.

Preferably angled notches communicate through the south end of the housing into the hollow interior thereof at spaced apart locations around the shaft, the notches being separated by intact extensions of the south end of the housing that reach inwardly toward the shaft at locations between the notches and southward of a shouldered exterior portion of the shaft to form stops for limiting movement of the shaft through the south end of the housing.

Preferably the drag plunger comprises at least one flow opening in the drag plunger at an area thereof disposed radially outward of the shaft for south to north passage of fluid through said drag plunger via said at least one flow opening.

Preferably the at least one flow opening of the drag plunger comprises a plurality of flow openings spaced evenly apart from one another circumferentially around the shaft.

Preferably a north cavity recesses into the drag plunger from a north end thereof, and the at least one flow opening opens into said north cavity of the drag plunger.

Preferably a south cavity recesses into the drag plunger form a south end thereof, and the at least one flow opening of the drag plunger and the hollow interior flow passage of the shaft both open into said south cavity of the drag plunger.

According to a second aspect of the invention there is provided a method of lifting a ball valve of a travelling valve assembly in a downhole pump and producing fluid through said travelling valve assembly, the method comprising, with a ball lift apparatus of a type comprising a drag plunger carried on a shaft slidably disposed in a surrounding housing attached to the travelling valve assembly at a location southward of a valve seat of the travelling valve assembly and arranged to lift the ball valve from the valve seat by movement of a north end of the shaft through an opening of the ball seat during of a downstroke of the downhole pump, and with the ball having been lifted from the ball seat during the downstroke of the downhole pump, flowing fluid northward through the opening of the ball seat via a hollow interior of the shaft that opens from said shaft at the northern end thereof.

Preferably the method includes simultaneously flowing the fluid northward past the ball seat via both the hollow interior of shaft and additional external flow passages disposed externally of the shaft between the shaft and the surrounding housing.

Preferably the method includes introducing the fluid to the external flow passages at a south end of the housing via flow openings found in the drag plunger at position spaced circumferentially around the shaft on which the drag plunger is carried.

Preferably the method includes first lifting the ball from the ball seat by at least one, and preferably both, of the north end of the shaft and application of a fluid pressure against the ball from within the hollow interior of the shaft.

BRIEF DESCRIPTION OF THE DRAWINGS

In the accompanying drawings, which illustrate one or more exemplary embodiments of the present invention.

DETAILED DESCRIPTION

Figure 1:
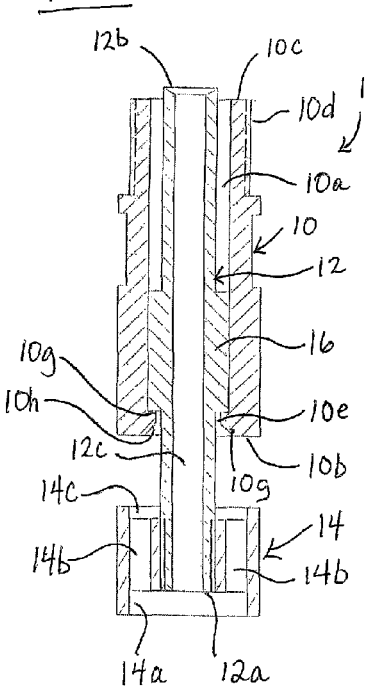
FIG. 1 is an assembled cross-sectional view of a ball lifter apparatus of the present invention for use with a ball-type travelling valve of a downhole pump.

Referring to FIG. 1, a hydraulically powered ball lifter 1 according to one embodiment the present invention is made up of three primary components, particularly a Hollow Pressure-Motion Housing 10, a Hollow Hydraulic-Power Shaft 12, and a Fluid Cavity Power Drag Plunger 14. The shaft 12 is partially disposed within an axially bored cylindrical portion of a hollow interior 10*a* of the housing 12. A set of radially extending guide ribs 16 are defined at an exterior of the hollow shaft 12 at circumferentially spaced locations evenly distributed therearound. The illustrated embodiment employs four guides 16, but this number may vary. This ribbed area of the shaft is disposed inside the hollow interior of the housing, and spans only a partial portion of the axial length of the housing's internal bore. The shaft 12 reaches outward from the housing through an opening at a south end 10*a* thereof, and is attached by threaded engagement and/or other means to the drag plunger 14 so as to carry the drag plunger 14 at a south end 12*a* of the shaft 12 outside the south end 10*b* of the housing 10.

Figure 6:
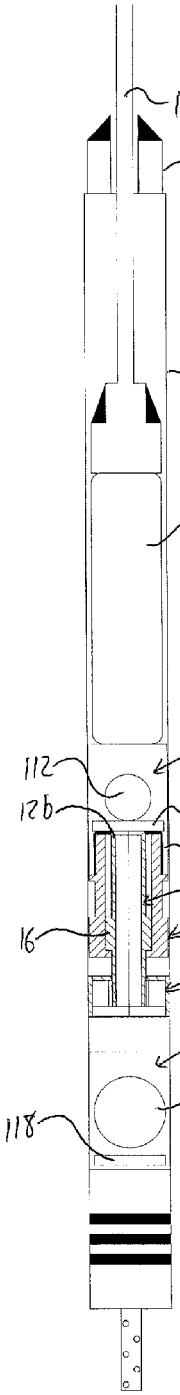
FIG. 6 is a schematic cross-sectional view showing the ball lifter of FIG. 1 in use within the pump barrel of a downhole pump in a wellbore, and showing a condition of the ball lifter during an upstroke of the downhole pump.

Turning to FIG. 6, the ball lifter of FIG. 1 is used in conjunction with a downhole pump of conventional construction featuring a pump barrel 100 mounted to south end of a string of production tubing 102 suspended in a wellbore for production of fluids to surface through the production tubing. In a conventional manner, a sucker rod string 104 is suspended in the production tubing to carry a pump piston 106 inside the pump barrel at the south end of this string of sucker rods for reciprocation of the piston 106 axially within the pump barrel 100 by a pump jack or other suitable pump drive unit at the surface. A travelling valve assembly 108 is mounted on or incorporated in the piston at the lower end thereof, and features a ball-seat 110 configured for flush seating of a ball valve 112 thereon in a position sealing closed a central opening in the annular ball seat 110 to define a closed state of the travelling valve. At a distance spaced axially southward from the travelling valve assembly in the pump barrel, a standing valve assembly 114 that is attached to or incorporated into the pump barrel 100 likewise features a ball valve 116 cooperatively disposed in combination with a suitable ball valve seat 118. In a known manner, as briefly summarized in the background section above, the two valves are cooperable to introduce fluids from the petroleum reservoir into the pump barrel, and convey same northward from same into the production tubing and further onward to the surface. The ball lifter of the present invention is attached to the travelling valve so as to operate the in space of the pump barrel between the two valves.

The north end 10*c* of the housing 10 of the ball lifter of the present invention is arranged for attachment to a south end of the travelling valve assembly, for example by external threading 10*d* arranged for coupling with a valve cage 120 thereof, such that the north end of the housing 10 resides at or shortly below the south end of the ball seat 110 of the travelling valve 108.

South end 10*b* of the Hollow Pressure Motion Housing 10 has a center opening 10*e* allowing for the drift or axial sliding of the Hollow Hydraulic-Power Shaft that reaches through this opening. The center hole 10*e* of the Hollow Pressure Motion Housing 10 has 6 flow notches 10*f* that cut radially into the circumferential wall of the housing 10 at spaced apart locations therearound. Each notch decreases in its radial reach from the central axis A of the internal bore of the housing in a direction moving northward, whereby the outer wall of each notch slopes inwardly in the northward direction so until the slot terminates a short distance northwardly into the hollow interior bore of the housing. The notches enable northward flow of fluid into the interior of the housing at spaced apart locations around the shaft 12 received in the center hole 10*e*. Between the flow notches 10*f* are six intact extensions 10*g* of the housing wall that reach radially into the internal bore of the housing relative to the notched out areas between the intact extensions.

The extensions define breaks or stops that shoulder up with south ends of the guides 16 on the shaft 12 so as to contain the ribbed portion of the shaft or stem in the housing so as not to fall Southward out of the Hollow Pressure Motion Housing 10. In other words, all four Guides 16 are shouldered breaks that break on the Hollow Pressure Motion Housing extenders to contain the Hollow Power Hydraulic Stem 12 as the Hollow Hydraulic-Power Shaft 12 travels Northward and Southward. The North area of the Hollow Hydraulic-Power Shaft spanning from the guides 16 to the north end 12*b* of the shaft 10 has an outside diameter that is round and smooth. Between each pair of guides 16 is a respective open straight flow area 18 spanning the full south to north extent of the guides 16 in order to create an external flow passage for movement of fluid between the shaft and the housing in this direction. Accordingly, these passages 18 continue the flow of fluid/gas entering the south end of the Hollow Pressure Motion Housing 10 through the notches 10*f*, guiding this fluid straight northward without changing the direction of the fluid/gas. In other embodiments, the guide ribs 16 and the flow passages 18 between them may depart from a linear configuration, and may angle or helically wind around the shaft axis, but the illustrated straight passages may be preferable.

Referring first to FIG. 6, which shows the ball lifter at the end of an upstroke of the downhole pump, at this point the shaft 12 resides in a first position in which the shoulders defined by the south ends of the guide ribs 16 of the shaft 12 shoulder against the inward extensions 10*g* at the south end of the housing. In this position, the shaft 12 carries the drag plunger 14 at a distance spaced southward from the south end 10*b* of the housing 10, and the north end 12*b* of the shaft resides at a retracted position aligned with or closely adjacent to the north end 10*c* of the housing 10 so that this end of the shaft stops short of reaching through the central opening of the ball seat of the travelling valve.

From this state, the downstroke of the pump is then initiated to drive the pump piston/plunger 106 southward. Hydraulic power is engaged on the on the ball lifter apparatus as it starts southward traveling on the down stroke as the northward and southward movable Fluid Cavity Power Drag Plunger 14 starts to frictionally drag against the inner surface of the pump barrel tube 100 in which it resides and reduces speed. This causes the Hollow Pressure Motion Housing 10, which is fixed to the southward traveling plunger/piston system 106 of the pump, to gain ground and make contact with the Fluid Cavity Power Drag Plunger 14. This southward movement of the housing 10 toward the drag plunger means that the housing 10 is also moving relative to the shaft 12 that is attached to the plunger. Accordingly, the Hollow Hydraulic-Power Shaft 12 moves northward (relative to the housing) into an extended position reaching outward from within the Hollow Pressure Motion Housing through the opening at the northern end 10*c* thereof and onward through the central opening of the ball seat of the travelling valve, which starts the first hydraulically-powered lifting motion northward against the travelling ball valve 112, thus releasing any pressure locked condition of the traveling ball valve that may exist.

Continuing the down stroke, the Fluid Cavity Power Drag Plunger 14 continues southward against the frictional resistance to same, and comes in contact with the fluid/gas held with the barrel tube. On contact with the plunger, the fluid/gas fills a void within the Fluid Cavity Power Drag Plunger as defined by a hollow cavity 14*a* opening thereinto from the south end thereof. The fluid/gas comes in direct contact with the top wall of this south cavity 14*a*, which is preferably flat and smooth and provides maximum initial impact force that pushes and holds the Fluid Cavity Power Drag Plunger 14 towards the Hollow Pressure Motion Housing 10 if the ball valve 112 is still in closed position, and successfully pushes and holds the plunger 14 against the housing 10 if the ball valve has now been forced into the open position.

The fluid/gas south of the plunger in the pump barrel instantaneously flows up northward through the flow hole passages 14*b* on the top circumference of the south cavity 14*a* in the Fluid Cavity Power Drag Plunger 14. In one embodiment, there is seven of these flow hole passages 14*b*, although this number may be varied within the scope of the present invention. Six of these seven flow hole passages 14*b* are spaced evenly around the circumference of the top of the south cavity 14*a* so as to be distributed evenly around the south end 12*a* of the shaft 12*a*. As the fluid/gas travels through these flow passages 14*b* in the plunger 14 to the north side of the Fluid Cavity Power Drag Plunger 14, it provides a cushion effect between a North cavity area 14*c* that is recessed into the north end of the plunger 14 and the South End 10*b* of the Hollow Pressure Motion Housing 10. This action softens impact between the housing and plunger as the Fluid Cavity Power Drag Plunger slows and makes contact with the Hollow Pressure Motion Housing. This action pushes the fluid/gas found between the north cavity 14*c* of the plunger 14 and the south end 10*b* of the Hollow Pressure Motion Housing inwardly toward the shaft via the angled notches 10*f*, thus preventing hard impact on the housing and plunger and also between the Hollow Hydraulic-Power Shaft 12 and ball valve 112 in the containment cage 120.

The seventh one of the flow hole passages 14*b* opening into the north and south cavities of the plunger is centered on the Fluid Cavity Power Drag Plunger 14 and receives the south end 12*a* of the shaft 12 so that fluid/gas is directed straight into the hollow-interior axial through-bore 12*c* of the Hollow Hydraulic-Power Shaft 12 from the south cavity 14*a* of the plunger 14. Via this straight internal through-bore 12*c*, the Hollow Hydraulic-Power Shaft captures the motion and pressure of fluid/gas via a straight-through south to north hollow passage that creates hydraulic power in a controlled straight flow passage northward and exhausts this fluid against the pressure-locked ball valve 112 of the travelling valve assembly, thereby gaining the ultimate hydraulic power directed centrally to the ball valve, providing hydraulic power to lift the pressure locked ball valve northward into the open position away from the north end 12*b* of the Hollow Hydraulic-Power Shaft.

Figure 7:
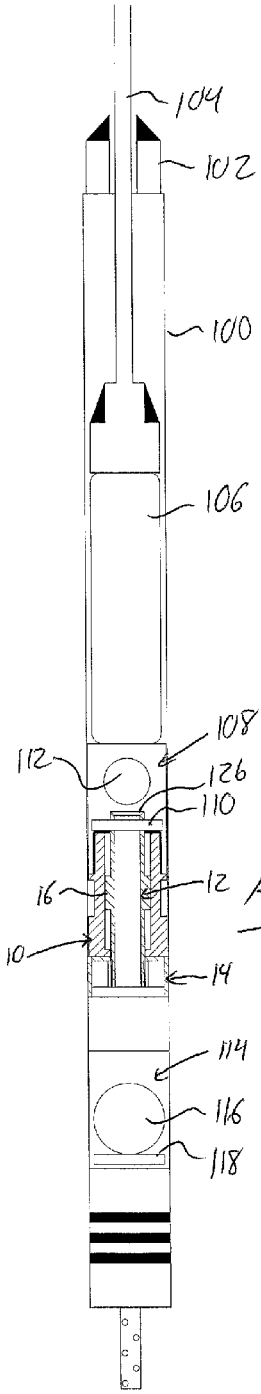
FIG. 7 is a schematic cross-sectional view similar to FIG. 6, but showing a condition of the ball lifter during an downstroke of the downhole pump.

The Hollow Hydraulic-Power Shaft 12 is threaded on its South end 12*a*, but continuing Northward from the threaded portion, the stem is smooth and round in circumference. Fluid/Gas enters the South end of the plunger's center flow hole and travels straight through the shaft's internal bore 12*c* in order to exhaust this fluid from the north end 12*b* of Hollow Hydraulic-Power Shaft 12. The axial center of the shaft 12 (midway between the north and south ends thereof) has the four guides 16 to maintain Hollow Hydraulic-Power Shaft 12 centered in relation to the Hollow Pressure Motion Housing 10, and this ribbed section of the shaft is of suitable length to allow adequate travel distance for the Hollow Hydraulic-Power Shaft 12 and Fluid Cavity Power Drag Plunger 14 between the retracted position of FIG. 6 and fully extended position of FIG. 7 in which the north end of the shaft reaches northward through the central opening of the travelling valve's ball seat.

The flow notches 10*f* continue the flow of fluid/gas traveling Northward from the top cavity 14*c* of the Fluid Cavity Power Drag Plunger northwards into the Hollow Pressure Motion Housing 10. In the illustrated embodiment, the Flow notches are angled only toward the central axis A of the housing 10, thus directing the fluid/gas flowing Northward from the top cavity of the Fluid Cavity Power Drag Plunger in a straight flow pattern, i.e. without inducing any helical or spiral action to the fluid flow. The center hole of the Hollow Pressure Motion Housing has a South end chamfer 10*h* at the underside of the extensions 10*g* in order to guide the fluid/gas inwardly toward the central axis A of the Hollow Pressure Motion Housing, which is coincident with central longitudinal axes of the shaft and plunger in the assembled apparatus. Fluid/Gas entering the housing 10 externally of the shaft 12 via the notches 10*f* after having passed south to north through the radially outer six of the seven flow passages 14*b* in the plunger is directed straight Northward along the shaft periphery between the guide ribs 16 thereon so as to exit the opening at the north end of the housing in an annular space between unribbed shaft circumference at this location and the surrounding annular north end 10*c* of the housing 10. This exterior flow of fluid makes contact with the closed ball valve enclosed in the valve containment cage 120, thereby providing 360-degree positive pressure on the closed ball valve to provide maximum opening power.

Figure 2:
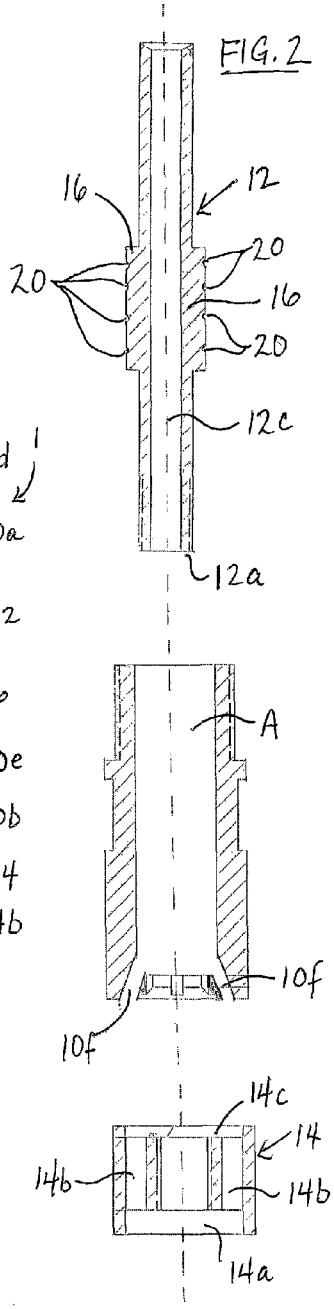
FIG. 2 is an exploded cross-sectional view of the ball lifter of FIG. 1.
Figure 3:
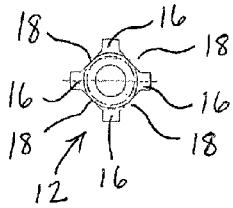
FIG. 3 is a top plan view of a hollow shaft of the ball lifter of FIG. 1, showing a north end thereof.
Figure 4:
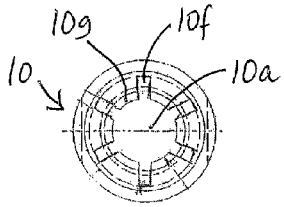
FIG. 4 is a bottom plan view of a housing of the ball lifter of FIG. 1, showing a south end thereof.
Figure 5:
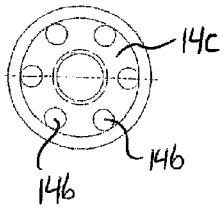
FIG. 5 is a top plan view of a drag plunger of the ball lifter of FIG. 1, showing a north end thereof.

The Hollow Hydraulic-Power Shaft 12 is open across its round inside diameter from its South to North end to control the flow of fluid/gas entering South end and exiting North end in a continuous straight flow pattern. Fluid/gas makes contact with the closed ball valve center in the containment cage, thereby applying positive pressure which generates greater lifting power to the closed ball valve. In the illustrated embodiment, the North end of the Hollow Hydraulic-Power Shaft 12 features a chamfer to better fit the ball valve in order to hold the ball in centered alignment with the North end exhaust flow hole of the shaft. In other embodiments, the north end of the shaft may be straight or flat. Hollow Power Hydraulic Stem guides 16 have a plurality of East to West grooves 20 on each of the guides at the radially outermost extents thereof at positions equally spaced along the axial north-south direction, so that each of these grooves interconnects the two external flow passage 18 on opposite sides of the guide rib 16. For ease of illustration, the grooves 20 are shown only in FIG. 2. In one embodiment, four such grooves may be provided in each guide 16, although this number may vary within the scope of the present invention. The grooves allow for any solids that get in between the inside diameter of the Hollow Pressure Motion Housing 10 and the outside diameter of the four guides to pass through as the Hollow Hydraulic-Power Shaft travels Northward and Southward, clockwise and counter clockwise, thereby preventing binding of the two.

As the Hollow Hydraulic-Power Shaft is engaged on the start of the down stroke the drag forces (friction force) of the Fluid Cavity Power Drag Plunger will actuate the Hollow Hydraulic-Power Shaft to come in contact with the closed ball valve and hydraulically start lifting the closed ball valve in the travelling valve containment cage in a Northward direction off the closed ball valve seating surface. The Hollow Hydraulic-Power Shaft gains full hydraulic lifting power once the Fluid Cavity Power Drag Plunger comes in contact with Fluid/Gas held within the barrel tube over the attached closed ball valve attached to the bottom of the barrel tube. This action lifts the ball valve into open position, and as the ball valve travels northward away from the Hollow Hydraulic-Power Shaft's preferably chamfered north end 12*b*; this opens the top end of the shaft's axial interior bore for full flow exhaust of fluid from the apparatus.

The Hollow Hydraulic-Power Shaft allows for the ball valve to lift away Northward from the Hollow Hydraulic-Power Shaft without any contact when the ball is in the open position on the down stroke allowing for the flow of fluid/gas traveling Northward within the Hollow Hydraulic-Power Shaft area to continue into the ball valve containment cage and Northward thereof. If the ball valve opens without requiring direct contact of the ball by the shaft, then the hollow shaft is nonetheless performing a useful function by providing the central flow path to maximize the fluid throughput.

In summary of the downstroke process, as the plunger/piston system and the fixed Hollow Pressure Motion House travel southward on the down stroke within the pump barrel tube, the freely movable Fluid Cavity Power Drag Plunger begins to slow in the southward motion due to the friction forces between the inner diameter of the barrel tube and the outer diameter of the Fluid Cavity Power Drag Plunger, thereby allowing the fixed Hollow Pressure Motion House to gain ground and catch up to the Fluid Cavity Power Drag Plunger causing contact with each other. As the Fluid Cavity Power Drag Plunger comes in contact with the fluid/gas contained within the barrel tube, the fluid/gas creates a northward force pushing on the south end of the Fluid Cavity Power Drag Plunger at the same time, in result creating a southward and a northward push as they travel towards the bottom of the pump barrel tube and the two opposite direction forces create a consistent hydraulic lifting power to the Hollow Power Hydraulic Shaft. In other words, there is a southward force and a northward force at the same time keeping the housing and drag plunger together, creating a consistent force on the ball valve via hollow shaft for the duration of the down stroke. This occurs in conjunction with the hydraulic power of the fluid/gas traveling straight northward to the center of the ball through the Hollow Power Hydraulic Shaft and the hydraulic power on the outside of the Hollow Power Hydraulic Shaft's straight flow guides to the outside circumference of the pressure locked ball valve and in return opening the ball valve to its open position within duration of the down stroke. This action is repeated on every down stroke.

The Hollow Hydraulic-Power Shaft on the start of the up stroke (northward movement of the housing 10 by the northward sucker rod and piston movement) comes in contact with the ball valve as the ball valve changes directions and falls southward, and the shaft may lower the ball valve back to the ball valve seat with less impact force for a smoother closing of the travelling valve.

On the upstroke the Fluid Cavity Power Drag Plunger 14 drags on the inside diameter of the barrel tube 100, which acts in conjunction with gravity pulling down on the weight of the Fluid Cavity Power Drag Plunger in a direction Southward of the Hollow Pressure Motion Housing, and the fully actuated Hollow Hydraulic-Power Shaft 12 is pulled Southward while guiding the ball valve with smoother impact back to the ball seat, until the north end of the shaft 12 retracts back inside the Hollow Pressure Motion Housing or at least a position retracted southward past the ball seat opening.

In other words, on the upstroke, the Fluid Cavity Power Drag Plunger drags in the opposite direction than it does the downstroke, being relatively pulled southward away from the Hollow Pressure Motion House as the Hollow Pressure Motion House is instantaneously being pulled northward, thus acting to separate the two on the start of the upstroke and for the duration of the upstroke. This action retracts the engaged Hollow Power Hydraulic Shaft relatively southward internally of Hollow Pressure Motion House, thereby lowering the open ball valve to its seating position with smoother impact.

At the start of the upstroke, there is also a second force southward on the Hollow Power Hydraulic Shaft created from the weight of the hydrostatic fluid above, and in conjunction with the upward motion of the upstroke, this pushes southward on the open ball valve toward the ball valve seat south thereof, and the ball comes in contact with the extended Hollow Power Hydraulic Shaft on the ball's way to the seat. The hydrostatic pressure thus pushes on the ball and shaft instantaneously with the above-described frictional pulling action on the Fluid Cavity Power Drag Plunger. As the ball valve is being pushed to the ball valve seat on the upstroke, the north end 12*b* of the Hollow Power Hydraulic Shaft 12 travels southward to its retracted position southward of the ball seat (and preferably residing internally of the Hollow Pressure Motion House), and the north end 12*b* of the shaft 12 thus leaves contact with the closed ball valve, which is therefore left seated atop the ball seat. This action is repeated on every upstroke.

In one embodiment, the outside diameter of the Hollow Pressure Motion Housing is round and smooth in circumference over most of its axial span, except for wrench flats which provided just south of the northern end. In the illustrated embodiment, the North end of the Hollow Pressure Motion Housing is threaded on its outside diameter and threaded into the containment cage's internal threads in order to join the two, but other coupling means may alternatively be employed to couple the housing to the travelling valve assembly.

The North end top surface of the Hollow Pressure Motion Housing may be flat, and smooth in circumference, so that when attached to the containment cage of the ball and seat valve, the seat rests parallel to the top surface of the housing, which operates as a seat plug to preventing the ball and seat valve from falling southward.

The Hollow Hydraulic-Power Shaft provides the ball lifter with hydraulic power on the down stroke to the center of the pressure locked ball valve within the containment cage north of the lifter apparatus with the energy derived from the fluid/gas being applied in a straight flow pattern, and also instantaneously provides hydraulic power to the circumference area around the Hollow Hydraulic Power Shaft's north end flow hole, thereby providing mechanical hydraulics powered by the derived energy force transferred northward from the obtained force of fluid/gas and friction drag forces of Fluid Cavity Power Drag Plunger. Hydraulic power is also derived from the fluid/gas around the outside diameter of the Hollow Hydraulic Power Shaft and the open hollow area within the Hollow Pressure Motion Housing in a straight flow pattern northward against the pressure locked ball valve. Hydraulic power of these forces provides full radius of northward lifting to the exposed south end of the pressure locked ball valve by hydraulic power delivered to the center of the ball valve, middle region of the ball's radius and to the outside circumference of the ball.

The disclosure above provides not only a novel apparatus, but also a distinct method allowing fluid/gas to continue traveling northward, preventing stalling and down time of the down hole reciprocating pump. The ball lifter thus defines a downhole pump component designed to prevent and fix gas locking of such downhole reciprocating pumps. The component of the illustrated embodiment is designed to stop common practice of "tagging bottom", or "Tapping" of the down hole reciprocating pump, in which operators are known to lower the stroke spacing to cause impact at the top of the downhole pump that in result causes jarring of the ball valve to open, and release a gas locked pump. The component may also assist in the performance of the down hole reciprocating pump, preventing downtime due to gas locked down hole reciprocating pumps. The illustrated embodiment is designed using linear fluid motion in a straight line, thus providing force in a linear fashion, is configured for use with a down hole reciprocating pump by adapting to the south end of a traveling valve containment cage, and is preferably fabricated from metal, for example using known machining techniques.

The illustrated embodiment, consisting of only three distinct pieces to assemble, is easily manufactured and prepared for use. The Hollow Hydraulic-Power Shaft is inserted with the south end threads southward into the Hollow Pressure Motion Housing north end. The Hollow Hydraulic-Power Shaft's south end and threads protrude south of the Hollow Pressure Motion Housing and attach to the internal threads centered of the Fluid Cavity Power Drag Plunger.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A ball valve lift apparatus for use with a reciprocating downhole pump having a travelling valve assembly on a piston that is slidingly disposed in a pump barrel and features a ball valve that seals against a ball seat when in a closed position, the ball valve lift apparatus comprising:

a hollow housing having a north end arranged for coupling to the piston of the downhole pump to reside in a position south of the ball seat of the valve assembly, the hollow housing having a hollow interior that is open to an exterior of the hollow housing at both the north end of the housing and an opposing south end thereof;

a shaft partially disposed within the hollow interior of the hollow housing in a manner slidable back and forth therein, the shaft having a hollow interior flow passage passing fully through the shaft in an axial direction from a south end of the shaft to an opposing north end of the shaft; and a drag plunger attached to a south end of the shaft disposed outside of the hollow housing beyond the south end of said housing for frictional contact of said drag plunger with an internal surface of the pump barrel, the hollow interior flow passage of the shaft being in fluid communication with a space external of the drag plunger beyond a south end of the drag plunger;

the shaft being slidable relative to the housing between a first position in which the drag plunger is spaced southward of the south end of the housing and the north end of the piston is disposed within the housing, and a second position in which the drag plunger is nearer to the south end of the housing than in the first position and the shaft projects externally northward of the housing from the north end thereof by a sufficient distance to displace the ball valve from the ball seat, thereby enabling fluid flow northward through the ball seat via the hollow interior flow passage of the shaft.

2. The apparatus of claim 1 comprising at least one external flow passage open between the shaft and internal surfaces of the housing to enable south to north passage of additional fluid through the housing externally of the shaft.

3. The apparatus of claim 2 wherein the shaft comprises guides at an exterior thereof for following the internal surfaces of the housing to guide relative sliding between the shaft and the housing, and the at least one external flow passage comprises a plurality of external flow passages defined between said guides.

4. The apparatus of claim 3 wherein the guides each comprise a plurality of grooves defined at a radially outermost extent of the guide, the grooves of each guide being spaced apart in a north-south direction and running between adjacent external flow passages on opposite sides of said guide.

5. The apparatus of claim 2 wherein angled notches communicate through the south end of the housing into the hollow interior thereof at spaced apart locations around the shaft, the notches being separated by intact extensions of the south end of the housing that reach inwardly toward the shaft at locations between the notches and southward of a shouldered exterior portion of the shaft to form stops for limiting movement of the shaft through the south end of the housing.

6. The apparatus of claim 2 wherein the drag plunger comprises at least one flow opening in the drag plunger at an area thereof disposed radially outward of the shaft for south to north passage of fluid through said drag plunger via said at least one flow opening.

7. The apparatus of claim 6 wherein the at least one flow opening of the drag plunger comprises a plurality of flow openings spaced evenly apart from one another circumferentially around the shaft.

8. The apparatus of claim 6 wherein a north cavity recesses into the drag plunger from a north end thereof, and the at least one flow opening opens into said north cavity of the drag plunger.

9. The apparatus of claim 6 wherein a south cavity recesses into the drag plunger from a south end thereof, and the at least one flow opening of the drag plunger and the hollow interior flow passage of the shaft both open into said south cavity of the drag plunger.

10. Method of lifting a ball valve of a travelling valve assembly in a downhole pump and producing fluid through said travelling valve assembly, the method comprising, with a ball lift apparatus of a type comprising a drag plunger carried on a shaft slidably disposed in a surrounding housing attached to the travelling valve assembly at a location southward of a valve seat of the travelling valve assembly and arranged to lift the ball valve from the valve seat by movement of a north end of the shaft through an opening of the ball seat during of a downstroke of the downhole pump, and with the ball having been lifted from the ball seat during the downstroke of the downhole pump, flowing fluid northward through the opening of the ball seat via a hollow interior of the shaft that opens from said shaft at the northern end thereof.

11. The method of claim 10 comprising simultaneously flowing the fluid northward past the ball seat via both the hollow interior of shaft and additional external flow passages disposed externally of the shaft between the shaft and the surrounding housing.

12. The method of claim 10 comprising introducing the fluid to the external flow passages at a south end of the housing via flow openings found in the drag plunger at positions spaced circumferentially around the shaft on which the drag plunger is carried.

13. The method of claim 10 comprising first lifting the ball from the ball seat using at least the north end of the shaft during the downstroke of the downhole pump.

14. The method of claim 10 comprising first lifting the ball from the ball seat using at least an application of fluid pressure against the ball from within the hollow interior of the shaft.

* * * * *